United States Patent [19]

Robinet

[11] 4,246,703

[45] Jan. 27, 1981

[54] ELECTRONIC DRAFTING INSTRUMENT WITH DIGITAL READOUT OF DISPLACEMENT

[76] Inventor: McLouis Robinet, 214 S. Elmwood Ave., Oak Park, Ill. 60302

[21] Appl. No.: 52,805

[22] Filed: Jun. 28, 1979

[51] Int. Cl.[3] ..... B43L 13/02

[52] U.S. Cl. ..... 33/430; 33/1 M; 33/125 C; 33/141 R

[58] Field of Search ..... 33/1 M, 125 C, 125 M, 33/141 R, 141 E, 403, 427, 430, 436, 447, 449, 476, 484, 485, 489, 494, 450

[56] References Cited

U.S. PATENT DOCUMENTS

| | | | |
|---|---|---|---|
| 3,728,551 | 4/1973 | Culver et al. | 33/141 R X |
| 4,069,588 | 1/1978 | Hoppe | 33/1 M |

FOREIGN PATENT DOCUMENTS

| | | | |
|---|---|---|---|
| 2751620 | 5/1978 | Fed. Rep. of Germany | 33/141 R |

OTHER PUBLICATIONS

Electronic Ruler, Mechanix, Ill. 9/79, p. 148.

*Primary Examiner*—Charles E. Phillips
*Attorney, Agent, or Firm*—Philip H. Kier

[57] ABSTRACT

Disclosed is an electronic integral drafting instrument which measures its own linear displacement and displays any desired multiple or submultiple of the actual displacement. The instrument includes a straightedged plate which houses: a displacement sensor with a driving wheel which projects beneath the plate, an electronic up-down counter and calculator type circuit, a scale factor keyboard, an electronic digital display, and a sensor which detects and annunciates if the displacement sensor driving wheel does not make proper contact with the drawing media. One embodiment of the invention is easily attached to conventional drafting machines as a replacement for regular straightedges and scales. A second embodiment of the invention may be used without a drafting machine. The leading straightedge of the instrument can be lifted or lowered into contact with the drawing media. An extension straightedge may be attached to the leading edge of the instrument. The instrument provides readout and storage of linear displacement in any unit system and any scale factor.

19 Claims, 10 Drawing Figures

Fig.4
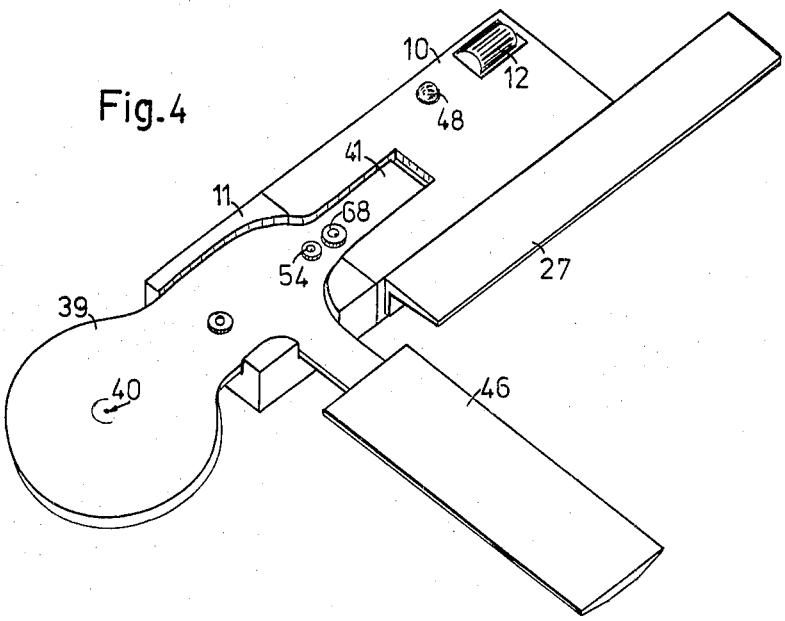
Fig.5C
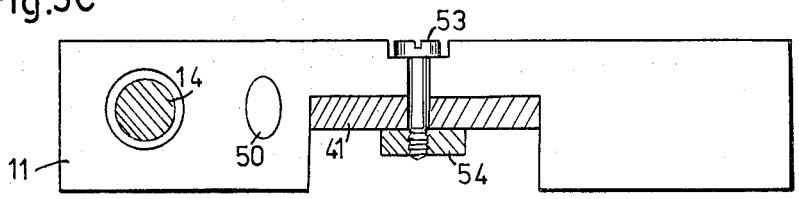
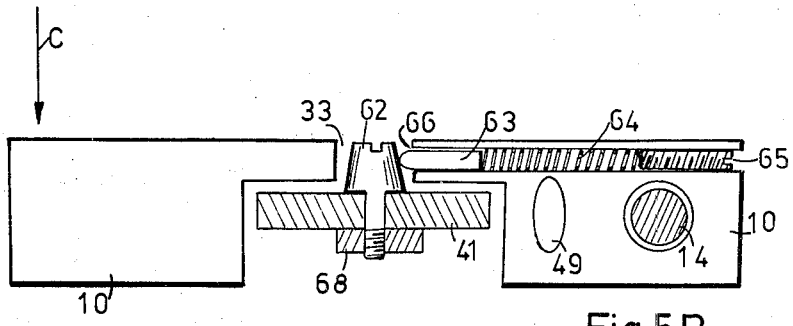
Fig.5B 20
30
32
31
26
23
25
24
27
13
18
12
21
44
35
37
10
36
19
22
34
15
16
17
62
33
53
50
51
66
29
28
11
14
5A
5B
5C 21
35
12
22
34
48
17
47
10
65
60
57
11
56
59
14

ELECTRONIC DRAFTING INSTRUMENT WITH DIGITAL READOUT OF DISPLACEMENT

BACKGROUND OF THE INVENTION

This invention pertains to instruments in the mechanical and technical drafting field used for drawing straight lines and specifically to an electronic drafting instrument which measures and displays its own linear displacement.

Despite the sophistication of modern engineering graphics, the measuring tools and techniques used by most draftsmen are essentially the same today as they were a century ago.

Most drafting measurements are made with scales, and dividers. When a scale is used to layout a measurement, an index mark on the scale is placed opposite a reference mark on the drawing another mark is placed opposite the desired measurement on the scale. An assortment of scales is usually required to accommodate different measuring units and scale factors.

When greater accuracy is required, measurements are usually taken between the open points of a pair of dividers and transferred to the drawing media by lightly pinpricking their location.

Using scales for layout measurements on complex drawings is time consuming, tedious and often eyestraining even for those with special skills.

It is, therefore, an object of this invention to provide a drafting instrument that will increase drawing efficiency, and reduce tedium and eyestrain.

The concept used to achieve that objective is embodied in an integral straightedged electronic drafting instrument which measures its own displacement and digitally displays the numbers in a large fixed size which is easy to read without eyestrain or the need for optical magnifiers.

The concept of a straightedge with some form of direct readout is old, but the physical embodiment of that concept taught in prior art such as U.S. Pat. Nos. 287,200 of Wach; 1,051,712 of Eager; 2,064,142 of Barany and 3,726,017 of DeMathe all have limitations for the professional draftsman.

Two of these limitations are: 1. lack of convenient easily read mean for displaying the total displacement beyond one revolution of a mechanical dial, 2. lack of convenient efficient means for automatically resetting the readout to zero.

In contrast to mechanical prior art self-measuring drafting instruments, this invention utilizes an electronic displacement sensor, an electronic up-down counter combined with a calculator type circuit, and an electronic digital display to overcome all of the above deficienceis.

The electronic principles involved are well known and are used, for example, in digital readout systems for lathes and milling machines, electronic digital planimeters, and electronic linear measuring probes.

Electronic linear measuring probes, which are electronic versions of mechanical cartometers, are of special interest because they could indeed by used to measure distances on drawings, as well as on maps. However, these probes are too cumbersome for creating original drawings because the readout, connected via a cable to the pen-like probe, is remote from the measuring probe. This is a serious limitation because the user is required to look away from the drawing surface to read the measurement corresponding to each probe position.

Still another limitation is that such probes must be used in conjunction with a separate straightedge, and to draw a line the full length of the straightedge, the probe must be removed to make way for a pen or pencil.

It is, therefore, another object of this invention to provide an integral straightedged electronic drafting instrument which electronically measures its own displacement and gives a continuous readout of the linear displacement directly on the straightedge so the user does not have to look away from the drawing surface to read the digital display.

Yet another object of this invention is to provide an integral straightedged electronic drafting instrument which measures and displays its own displacement and can be used as a direct replacement for conventional scales and straightedges used on state-of-the-art drafting machines.

Another limitation of the prior art is that no means is provided to warn the user if the instrument is unknowingly lifted from the drawing surface during a measurement. This is important because the displayed results would be less than the true displacement. It is, therefore, another object of this invention to provide an integral straightedged drafting instrument which measures and displays its own displacement and has a contact sensor and annunciator to warn the user whenever the instrument is lifted such that the measurement may be in error.

SUMMARY OF THE INVENTION

This invention is a straightedged drafting instrument which measures its own displacement as it is moved over a drawing media and reads out the results on a large easy-to-read digital display. The display is mounted directly to the instrument near its leading straightedge so the user does not have to look away from the drawing to read the display.

The body of the instrument is a flat plate-like chassis or compartment which houses one or more drive wheels, a direction sensing displacement sensor such as an optical or electromagnetic direction sensing rotary incremental encoder, a pulse processing circuit comprised of an up-down counter and a calculator type circuit, a scale factor keyboard, a digital display such as the liquid crystal, light emitting diode, or electrofluorescent type, and a contact sensor and annunciator.

The direction sensing displacement sensor is driven by one or more wheels or rollers which are mounted to the plate and which turn when the plate is moved over the drawing media. The wheels are mounted to the plate such that the plate is lifted slightly above the drawing surface and may be moved about without smearing the drawing. The direction sensing displacement sensor produces electronic pulses as the plate is moved and the number of pulses is proportional to the displacement of the plate. The number of pulses from the sensor is processed by the combination up-down counter and calculator-type circuit, and readout on the digital display.

The display may be reset to zero at any time via the keyboard. The keyboard also allows the user to select any scale factor or length unit desired. The total length which can be measured is limited only by the number of digits which can be readout on the selected display. The smallest distance which can be measured is determined by the resolution of the rotary incremental encoder and 0.010 to 0.005 inch would be typical.

The calculator part of the pulse processing circuit may be used independent of its pulse processing function. The user could, for example, add or subtract any number to a displayed measurement, take the square root of a displayed measurement, or use the calculator for a computation unrelated to any measurement.

The contact sensor and annunciator are provided to warn the user that the drive wheel was lifted from the drawing surface and the displayed measurement may be in error and should be repeated. The annunciator is a sounder and/or blinking digital display.

The user of this invention is not required to learn complex new skills because it is used in the same manner as any straightedge.

In a typical use, for example, the leading straightedge is used to draw a straight line or it is aligned with an existing line or point on a drawing. When the instrument is moved to another position on the drawing, the displacement is continuously read out on the digital display. The instrument might be moved until some desired number is displayed, or used to measure the displacement between existing lines or points on a drawing. The leading straightedge of the instrument is always at the end point of any measurement.

In one preferred embodiment of this invention, the plate or chassis is sectioned into two parts or compartments and hinged together end-to-end such that one part may be attached to a commercial drafting machine while the other part remains free so its leading edge can be pressed into contact with a drawing surface.

BRIEF DESCRIPTION OF THE DRAWINGS

FIG. 4 shows an underside perspective view of the instrument attached to one tang of the protractor plate on a commercial drafting machine. A conventional scale is shown attached to the other protractor plate tang.

FIG. 5B is a cross-sectional view of the instrument taken on the line 5B—5B of FIG. 5 showing cone head bolt, plunger, etc.

FIG. 5C is a cross-sectional view of the instrument taken on the line 5C—5C of FIG. 5 showing fixed compartment attached to one tang of protractor plate of a commercial drafting machine.

DETAILED DESCRIPTION OF THE PREFERRED EMBODIMENTS

Figure 1:
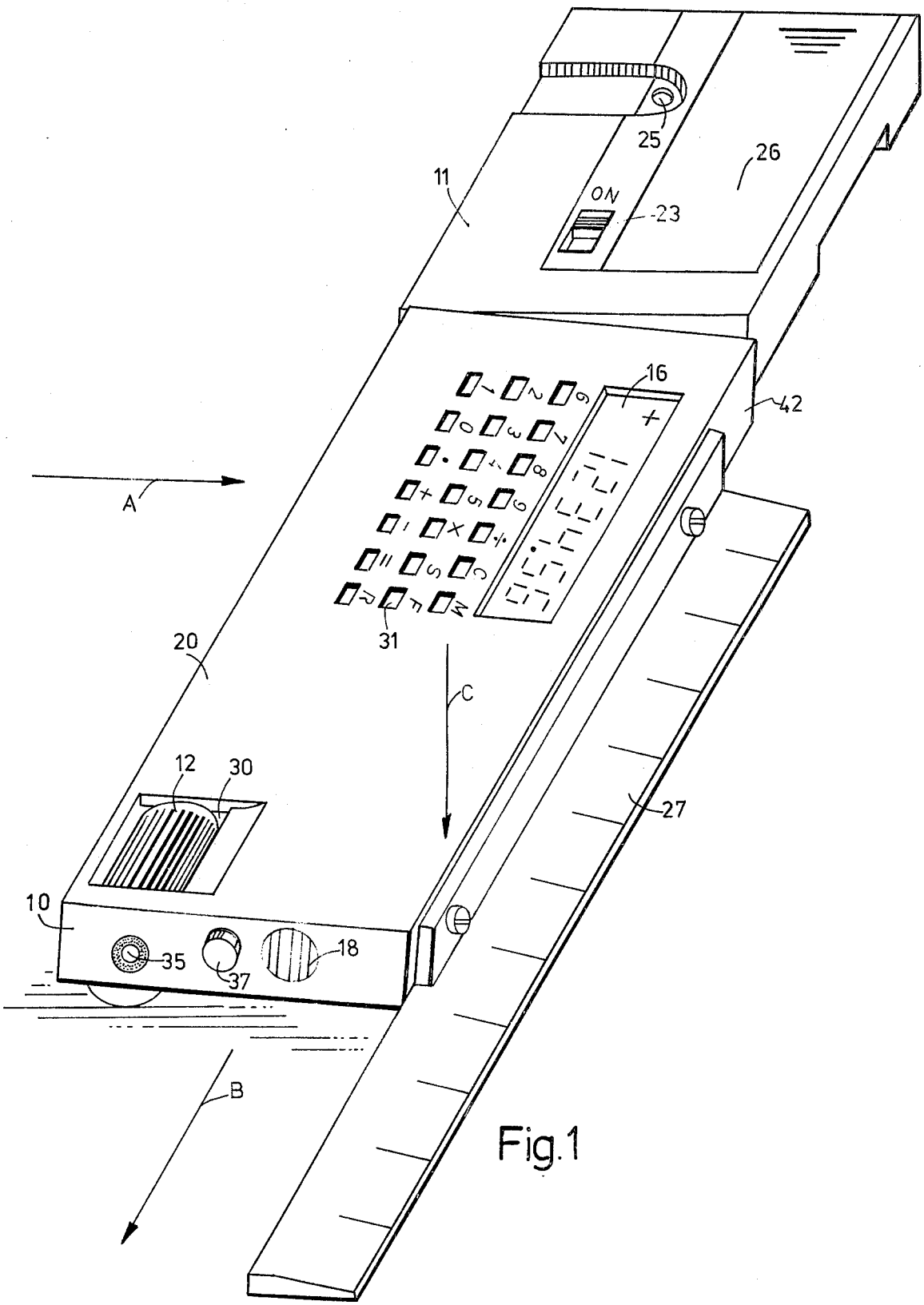
FIG. 1 is a perspective view of the drafting instrument showning a compartment with attached extension straightedge tilted downward.
Figure 5:
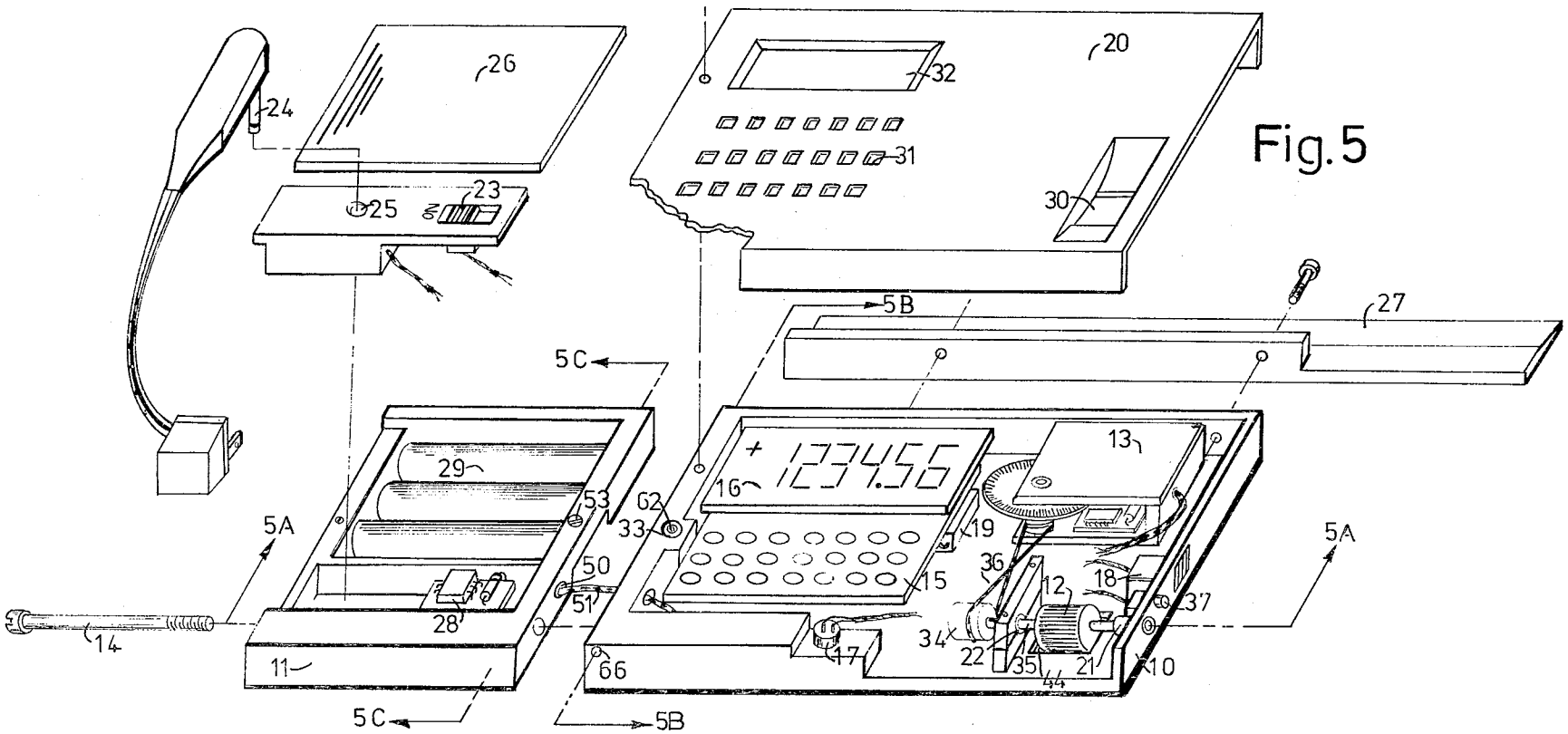
FIG. 5 is a partially exploded top perspective view of the instrument.
Figure 5A:
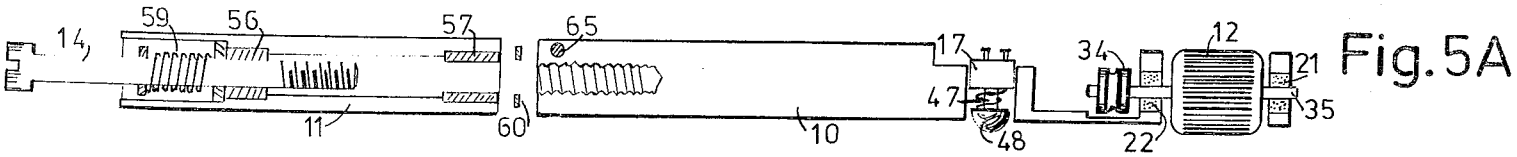
FIG. 5A is a back elevation view of the instrument partly sectioned along lines 5A—5A of FIG. 5 showing drive wheel, hinge pin, and contact sensor. The two compartments are shown unattached.

Referring to FIG. 1, there is illustrated a self-measuring electronic drafting instrument with a flat main chassis 10 having a straightedge portion 42 and a similar companion chassis or compartment 11 which are pivotally connected together end-to-end with hinge bolt 14 (shown in FIGS. 5 and 5A). The pivotal connection allows the plane of the main chassis to be changed while keeping that of the companion chassis fixed. The object of this feature in a preferred embodiment will be explained as this description proceeds. A rotatable drive wheel 12 is fixed to shaft 35 which rotates in bearings 21 and 22 (FIGS. 5 and 5A), that are attached to the main chassis. Drive wheel 12 protrudes below the underside of the main chassis 10 through opening 44. Shaft 35 need not show outside chassis 10, but is so drawn for clarity.

Figure 2:
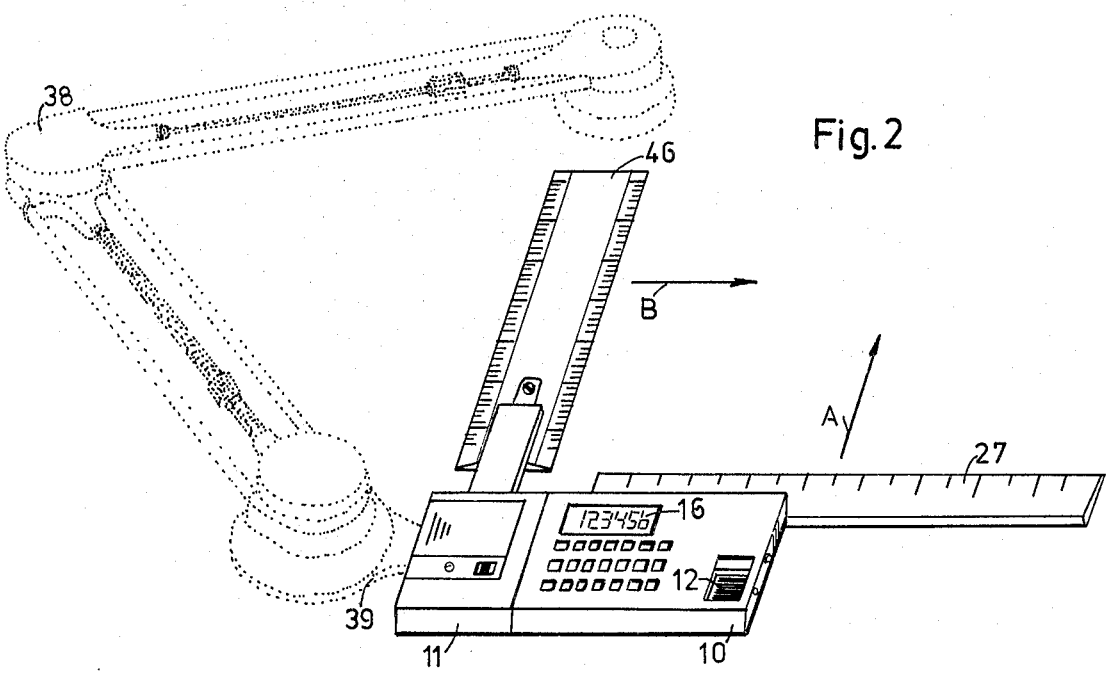
FIG. 2 is a perspective view of the drafting instrument attached to a commercial drafting machine.

FIG. 2 shows the instrument attached to one tang 41 (see FIG. 4) of a standard protractor plate 39 on a commercial drafting machine 38 in replacement of a conventional straightedge scale such as 46.

The drive wheel 12 rotates when a force in the plane of the drawing media or similar surface is applied to the drafting machine or directly to the instrument. The drive wheel 12 is splined parallel to the shaft to provide positive rolling traction. If the direction of motion is parallel to the drive wheel shaft 35, such as indicated by arrow B, the wheel will not rotate, but will slide over the surface. If the direction of motion is diagonal, the instrument measures the component of displacement perpendicular to the shaft. Both ends of the drive wheel are rounded to prevent snagging the drawing media when the wheel must slide.

Rotation of the drive wheel 12 is transmitted by a pulley 34 (see FIG. 5) and belt 36, or other rotation transmission means such as a gear train, to an electronic direction sensing (clockwise or counterclockwise) rotary incremental encoder 13 such as U.S. Pat. No. 3,912,926 of Coulbourn which is fixed to chassis 10, and which produces pulses whose number are proportional to the rotational displacement of the drive wheel. The rotary encoder has a shaft (not shown) to which a pulley similar to 34 is fixed for accepting belt 36. The number of revolutions of the drive wheel, from some reference point, is directly proportional to the verticle component of the instrument displacement so the number of pulses produced by the incremental encoder is proportional to the vertical displacement. The encoder simultaneously produces two train of pulses which are 90° out of phase to each other so clockwise and counterclockwise rotation may be distinguished.

Pulses from the encoder are fed to an LSI semiconductor chip in package 19 which includes an up-down counter and calculator circuit, such as described in U.S. Pat. No. 3,924,110 by Cochran and Grant, and the number of processed pulses are read out on an electronic digital display with large easily read characters. The digital display is mounted in chassis 10 near the leading edge of the chassis so the user does not have to look away from his drawing to read the display. The display is electronically reset to zero by pressing a key on recessed scale factor keyboard 15 so the user may begin a new measurement at any reference point on the drawing. The up-down counter portion of the circuit in 19 adds to the displayed number when the instrument is moved upward (direction of arrow A) from some reference point and subtracts from the displayed number when the instrument is moved downward (opposite direction of arrow A). All displacements above a zero reference point are displayed with a positive sign prefix while displacements below the reference point are displayed with a negative sign prefix. The display always shows the displacement from some point at which the display was reset to zero.

The calculator part of the circuit is used to automatically multiply or divide the number of pulses produced by any number chosen via the scale factor keyboard. That is, the calculator circuit allows the user to use any scale factor and any measuring system desired.

The true displacement may be displayed in centimeters, meters, inches, feet, etc. by recalling the appropriate calibration factor from the calculator's permanent memory. The calibration factor will depend on the drive wheel diameter, ratio of the pully diameter of the drive wheel shaft to that of the encoder shaft, and the number of encoder pulses produced per encoder revolution. The calculator's non-permanent memory is used to store measurements for later use. The display 16, LSI circuit package 19, and scale factor keyboard 15 are mounted on a common circuit board which is attached to the main chassis 10.

The scale factor keyboard 15 is operated by inserting a slender object such as the end of a pen or pencil through holes such as 31 in chassis cover 20. The recessed keyboard makes it less likely to unintentionally change a scale factor.

The combination of a driven encoder with an electronic digital display as described in this embodiment is capable of very high precision, but the user may unfortunately obtain erroneous measurements if he unknowingly temporarily lifts the instrument during a measurement and the drive wheel temporarily stops rotating. The displayed measurement would be less than the true displacement. To avoid this potential source of error, the instrument is provided with a contact sensor or switch 17 (see FIGS. 5 and 5A) which is attached to chassis 10 and which activates sounder 18 whenever the instrument is lifted enough that the drive wheel might slip. The spring loaded actuating pin 47 of switch 17 has a rounded end 48 (FIG. 5A) which slides over the drawing media. The sounder 18 is silenced by temporarily depressing button 37 mounted on the side of chassis 10.

A power source such as rechargeable batteries 29, a voltage regulator 28, main power switch 23, and an AC adaptor-recharger jack 25 for plug 24 are housed in companion chassis 11 and its cover plate 26. The main chassis 10 and companion chassis 11 have through openings 49 and 50 (see FIGS. 5B and 5C) to pass internal power cable 51 from chassis 10 to chassis 11.

It was mentioned in the beginning of this description that chassis 10 and chassis 11 are pivotally connected together with hinge bolt 14 (see FIGS. 5 and 5A) so that the plane of main chassis 10 could be changed while keeping that of companion chassis 11 fixed. We are now in a better position to explain the purpose of that feature.

Drive wheel 12 holds chassis 10 and 11 slightly above drawing media to prevent unnecessary resistance to motion, prevent smearing finished drawings, and also to prevent the extension straightedge 27 from snagging edges of the drawing media. However, the straightedge should be in direct contact with the drawing media whenever it is alligned opposite a reference point or it is used to guide a pen or pencil for drawing a line. The pivotal connection between chassis 10 and 11 achieves that objective. The companion chassis 11 is rigidly attached to a part of the drafting machine protractor plate tang 41 (see FIG. 4) with bolt 53 and nut 54 (see FIG. 5C) but the leading edge of main chassis 10 may be tilted downward in direction indicated by arrow C in FIGS. 1 and 5B so extension straightedge 27 touches the drawing media. FIG. 5A shows that hinge bolt 14 screws into chassis 10 and rotates in bearings 56 and 57. The spring 59 keeps chassis 10 and 11 close together against thin thrust washer 60, but still allows free pivotal movement without requiring critical adjustment of hinge bolt 14. The leading edge of chassis 10 is prevented from dragging and is kept in essentially the same plane as chassis 11 by a restoring means consisting of cone head bolt 62 (see FIG. 5B) plunger 63, restoring spring 64, and adjusting screw 65. The chassis 10 has a cavity 66 for the plunger, restoring spring, and adjusting screw. The cavity is large enough for the plunger 63 to slide freely. When a force perpendicular to the plane of the drawing media (direction indicated by arrow C in FIGS. 1 and 5B) is applied near the leading edge of chassis 10, chassis 10 pivots about hinge bolt 14, and plunger 63 slides down the tapered side of cone head bolt 62 compressing restoring spring 64. When the applied force is removed, the compressed spring 64 forces the plunger 63 to slide back up the cone head bolt 62 and restores the chassis to its original plane. Note that the cone bolt 62 is rigidly attached to tang 41 by nut 68 and that hole 33 in chassis 10 is sufficiently large so the chassis does not touch the cone bolt 62. If it did, it would interfere with its free pivotal motion. Note also that there is sufficient clearance between the top surface of tang 41 and chassis 10 to allow the chassis to pivot enough for the straightedge to touch the drawing media.

The adjusting screw 65 is used to increase or decrease the compression of spring 64 and, thereby, vary the force required to press the extension straightedge into contact with the drawing media.

The opening 30 in cover 20 (see FIGS. 1 and 5) allows the user to place a finger on the drive wheel to control small movement of the instrument. The opening 30 also allows the wheel to be cleaned without turning the instrument over. The opening 32 in cover 20 is for display 16.

The invention is not limited to the particular details of construction of the embodiment depicted, and it is expected that modifications and applications will occur to those skilled in the art.

Figure 3:
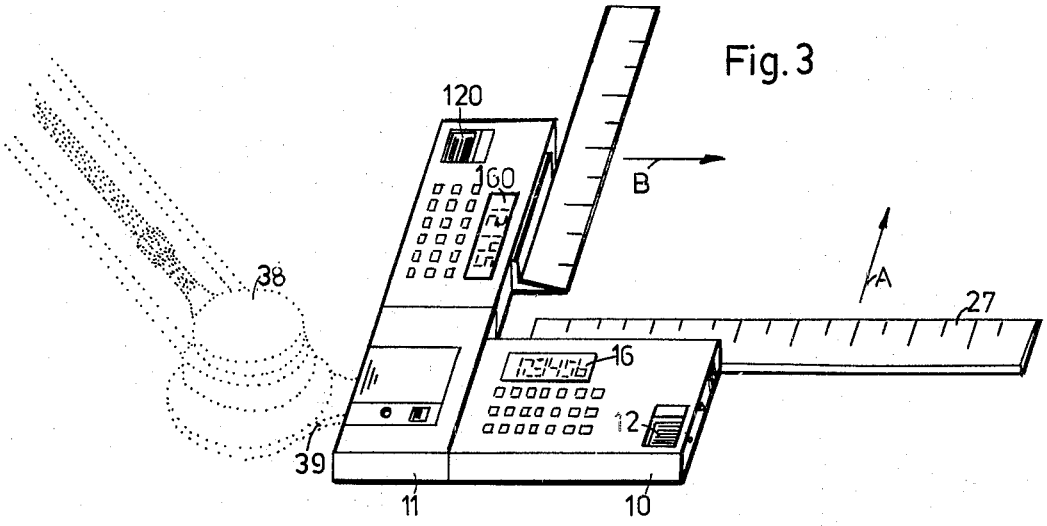
FIG. 3 is a perspective view of two instruments combined at right angles to each other and attached to a commercial drafting machine.

For example, it is clear that two independent instruments could be used on a commercial drafting machine to replace both conventional scales, or that an alternative embodiment could combine two instruments at right angles to each other as in FIG. 3. Rotation of wheel 12 is proportional to the vertical component of displacement and is read out on display 16. The rotation of wheel 120 (in FIG. 3) is proportional to the horizontal component of displacement and read out on display 160.

It should also be clear to those skilled in the art that the instrument may be used on drafting machines other than the depicted elbow type.

Figure 6:
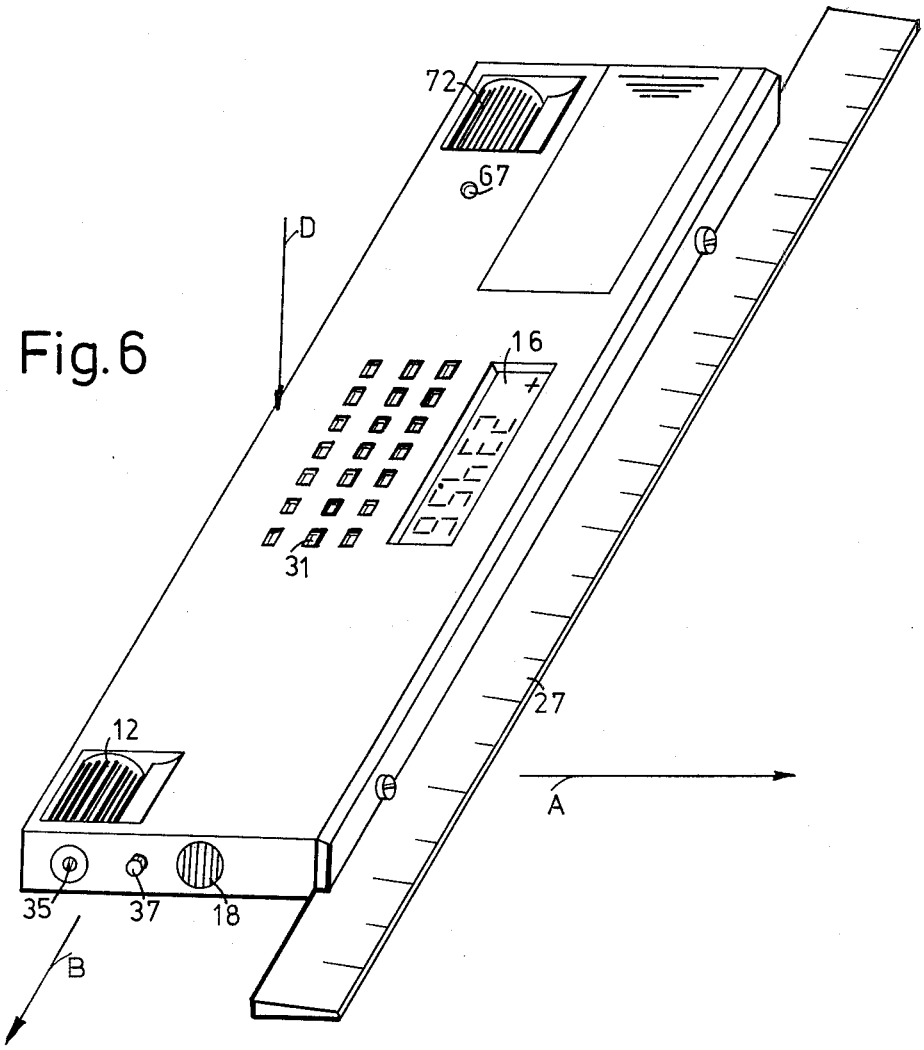
FIG. 6 is a perspective view of an alternative embodiment of the instrument.
Figure 7:
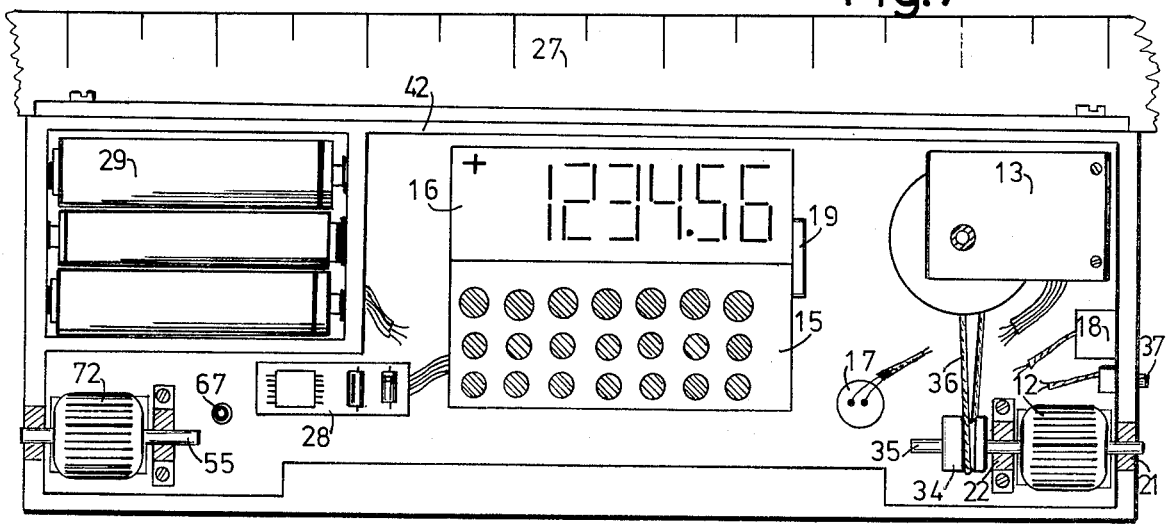
FIG. 7 is a top plan view of the instrument shown in FIG. 6 with cover removed.

FIG. 6 shows still another embodiment for use without a drafting machine. It uses two displaced drive wheels, 12 and 72, on a common axis. Only one wheel, 12, drives the encoder. In this embodiment the pivotal connection between chassis 10 and 11 is unnecessary because the entire instrument can be pivoted about shaft 35 and 55 shown in FIG. 7. The leading edge is lifted above the drawing media by applying a downward force along the rear edge of the instrument, behind the axial line of the drive wheels, as indicated by arrow D in FIG. 6.

The leading edge is normally touching the drawing media and is lifted as described whenever the instrument is moved over a drawing. Note that this is opposite from the embodiment, used with drafting machines, where the leading edge of the instrument is normally held above the drawing media and a force must be applied, such as indicated by arrow C in FIG. 1, to make it touch the media.

The embodiment with two independent drive wheels (FIG. 7) would be used to follow an external straightedge. It is well known that if both wheels are fixed to a common shaft, the instrument will track in a straight line without external guidance.

An application which will be evident to those skilled in the art is that the instrument may also be used to measure angular displacement by using the equation $A=D/R$ where A is the angular displacement in radians, D is the linear displacement along the arc, and R is the distance from the pivot point to the drive wheel. Commercial drafting machines have a built-in protractor which pivots about a point such as 40 shown in FIG. 4 so the distance R could be stored in the calculator memory such that angular displacements could be read directly. Similarly, the alternative embodiment shown in FIGS. 6 and 7 could be pivoted through an aperture 67 in the chassis. The aperture could be accurately positioned over the desired pivot point on a drawing by looking through the aperture.

Therefore, because certain changes may be made in the above described instrument without departing from the true spirit and scope of the invention, it is intended that the subject matter of the above depiction shall be interpreted as illustrative and not in a limiting sense.

I claim:

1. An integral self-measuring electronic drafting instrument comprising:

a chassis having a straight edge portion;

a rolling means mounted to the chassis by a shaft and bearings such that the rolling means rotates when the chassis is moved over a drawing media;

a direction sensing displacement sensor which is fixed to the chassis and is driven by the rolling means and produces electronic pulses whose number are proportional to the displacement (from a selected reference point) of the rolling means;

a transmission means by which rotary motion from the rolling means is communicated to the direction sensing displacement sensor;

an electronic pulse processing means which is housed in the chassis and processes pulses from the direction sensing displacement sensor such that the number of pulses accumulated increases when the chassis is moved in one direction and the number of pulses accumulated decreases when the chassis is moved in the opposite direction, the pulse processing means also being capable of modifying the number of pulses, the modification being multiplication and division by any chosen number and, the modification being other mathematical operations;

a digital display means which is mounted in the chassis and continuously reads out the accumulated number of pulses from the pulse processing means;

a means mounted on the chassis for selecting the mathematical operation and the number by which the electronic pulse processing means will modify the accumulated number of pulses before they are read out on the digital display means; and a contact sensor means and annunciator means, both mounted to the chassis such that a warning is announced when the rolling means is lifted from the drawing media.

2. An integral self-measuring electronic drafting instrument as described in claim 1 wherein the rolling means is a wheel which is fixed to the shaft and, the bearings are fixed to the chassis.

3. An integral self-measuring electronic drafting instrument as described in claim 2 wherein the wheel has traction splines parallel to the shaft and the chassis has an opening for the wheel to pass through and to protrude below the chassis so the chassis rides slightly above the drawing media.

4. An integral self-measuring electronic drafting instrument as described in claim 1 wherein the means for selecting the mathematical operation and the number by which the electronic pulse processing means will modify the accumulated number of pulses before they are read out on the digital display means is a keyboard.

5. An integral self-measuring electronic drafting instrument as described in claim 1 which further comprises:

an extension straightedge attachable to the straightedge portion of the chassis;

a cover which fits over the chassis and has openings for the digital display means and the keyboard;

a power supply means and a voltage regulator means mounted in the chassis; and a receptacle means for connecting an external source of power to the power supply means mounted in the chassis.

6. An integral self-measuring electronic drafting instrument as described in claim 1 wherein the direction sensing displacement sensor is a direction sensing rotary incremental encoder.

7. An integral self-measuring electronic drafting instrument as described in claim 1 wherein the transmission means by which rotary motion from the rolling means is communicated to the direction sensing displacement sensor includes:

a first pulley fixed to the shaft of the rolling means;

a second pulley fixed to the drive shaft of the direction sensing rotary incremental encoder; and a belt between the first and second pulley.

8. An integral self-measuring electronic drafting instrument as described in claim 1 wherein the electronic pulse processing means is a combination up-down counter and calculator type LSI circuit.

9. An integral self-measuring electronic drafting instrument as described in claim 1 wherein the contact sensor means is a switch which includes a spring loaded actuating pin connected to the switch contacts, one end of the pin being smooth and rounded to slide over the drawing media with minimum friction.

10. An integral self-measuring electronic drafting instrument as described in claim 1 wherein the annunciator is a sounder.

11. An integral self-measuring electronic drafting instrument as described in claim 1 which further comprises a switch for silencing the sounder, the switch being mounted to the chassis, the switch having an attached button which is accessible outside the chassis.

12. An integral self-measuring electronic drafting instrument as defined in claim 1 wherein the chassis includes a first and second compartment which are attached end to end by pivotal means.

13. An integral self-measuring electronic drafting instrument as defined in claim 12 wherein the first compartment has means for rigid attachment to a commercial drafting machine such that the second compartment is free to tilt relative to the plane of the first compartment, the rolling means with its shaft and bearings being attached to the second compartment.

14. An integral self-measuring electronic drafting instrument as described in claim 12 wherein the pivotal means includes:

bearings fixed to the first compartment, and a hinge bolt which passes through the bearings and is fixed to the second compartment such that the two compartments may be held close together but remain free to pivot about the hinge bolt.

15. An integral self-measuring electronic drafting instrument as described in claim 12 wherein the second compartment further comprises restoring means by which the second compartment is forced to return to its original plane after removal of the force which was used to tilt its leading edge into contact with a drawing media.

16. An integral self-measuring electronic drafting instrument as described in claim 14 wherein the restoring means includes:

a cone head bolt attached to a drafting machine, the cone head bolt passing through the second compartment but does not directly touch the second compartment, the second compartment having a hole, for passage of the cone head bolt, which is larger than the diameter of the cone head bolt;

a movable plunger which slides up and down the cone portion of the cone head bolt, the second compartment having a cavity to contain the movable plunger;

a spring which presses the plunger against the cone portion of the cone head bolt; and an adjusting screw used to increase or decrease the compression of the spring.

17. An integral self-measuring electronic drafting instrument described in claim 1 wherein the rolling means is a pair of mutually displaced wheels on a common axis, both wheels being free to rotate independent of the other.

18. An integral self-measuring electronic drafting instrument described in claim 1 wherein the rolling means is a pair of mutually displaced wheels fixed to a common shaft which rotates in bearings mounted to the chassis.

19. An integral self-measuring electronic drafting instrument as described in claim 1 wherein the chassis has an aperture for sighting a desired pivot point on a drawing, and for inserting a pointed object about which the chassis may be pivoted over a point on a drawing.

* * * * *